United States Patent [19]

Martin et al.

[11] Patent Number: 4,950,169

[45] Date of Patent: Aug. 21, 1990

[54] UNIVERSAL CABLE CONNECTOR FOR ELECTRONIC DEVICES

[75] Inventors: Fred L. Martin; David N. Brozenick, both of Knoxville, Tenn.

[73] Assignee: PC Industries, Inc., Knoxville, Tenn.

[21] Appl. No.: 322,215

[22] Filed: Mar. 13, 1989

[51] Int. Cl.[5] ..... H01R 13/68; H01R 13/66

[52] U.S. Cl. ..... 439/44; 439/49; 439/76; 439/516; 439/620; 439/622

[58] Field of Search ..... 439/43, 44, 516, 76, 439/49, 620–622, 915

[56] References Cited

U.S. PATENT DOCUMENTS

| | | | |
|---|---|---|---|
| 3,327,174 | 6/1967 | Barre et al. | 439/49 X |
| 4,090,667 | 5/1978 | Crimmins | 339/19 |
| 4,389,080 | 6/1983 | Clark et al. | 339/14 R |
| 4,471,158 | 9/1984 | Roberts | 174/52 FP |
| 4,508,414 | 4/1985 | Kusui et al. | 339/143 R |
| 4,610,493 | 9/1986 | Masek | 339/14 R |
| 4,618,196 | 10/1986 | Muzslay | 439/76 X |
| 4,689,023 | 8/1987 | Strong, III et al. | 439/516 X |

*Primary Examiner*—Steven C. Bishop

*Attorney, Agent, or Firm*—Pitts and Brittian

[57] ABSTRACT

A universal connector of the "D"-type for use on the ends of cables connecting electronic equipment, the connector permitting ready customizing for particular applications. A circuit board is inserted, in one embodiment within the hood shield of the "D"-type connector that has a terminal strip for the mechanical joining of wires of the cable. This circuit board also has junction points for being joined, as by soldered connections, to pins of the connector, and fuse links joining the terminal strip and the junction points. In another embodiment, the circuit board and its components is within an auxiliary body, with this auxiliary body being connected to the "D"-type connector via pigtail cable. The connector is customized by electrically destroying (blowing) selected fuse links by passing current therethrough whereby the remaining fuse links form selected circuit paths between the pins of the connector and the cable. Provision is made to sufficiently isolate each fuse link so as to permit the blowing of the selected individual fuse units. This protection is afforded by resistive units at selected locations associated with the fuse links.

9 Claims, 4 Drawing Sheets

UNIVERSAL CABLE CONNECTOR FOR ELECTRONIC DEVICES

DESCRIPTION

1. Technical Field

The present invention relates generally to connectors for releasably joining cables to pieces of electronic equipment, such as associated with computer systems, and more particularly to a cable connector that can be universally used at the end of these cables to simplify the joining of the cables to a large number of "D"type connectors on the equipment for a specific installation.

2. Backround Art

Many types of computer components almost universally utilize interconnecting cables that are terminated at "D"-type connectors which are then releasably connected to corresponding connector components on the equipment. These components typically include the computer itself, terminals, modems, printers, and input-/output applications. These "D"-type connectors, which, are illustrated as prior art in U. S. Pat. No. 4,508,414, for example, are metal-shielded devices having a number of connecting pins. (As used herein, the term "pin" is used for either male or female connecting components.) Typical connectors in common use have 9, 15, and 25 pins depending upon the application of the system and the particular component in the system.

Other references which may be pertinent to the present invention are U.S. Pat. No. 4,090,667 issued to D. J. Crimmins on May 23, 1978; U.S. Pat. No. 4,389,080 issued to (R. E. Clark et. al. on June 21, 1983; U.S. Pat. No. 4,471,158 issued to J. A. Roberts on Sept. 11, 1984; and U.S. Pat. No. 4,610,493 issued to R. C. Masek on Sept. 9, 1986;

These prior art "D"-type connectors are joined to their respective cables by individually soldering wires of the cable to the desired pins thereof. In addition, a variety of "jumper" connections must be joined between selected of the pins. This, while time consuming, can be accomplished with reasonable ease on a routine basis for "standard" cables. However, when special cables are to be fabricated (since equipment of different manufacturers require different cable connections), or when connectors are to be joined "in-the-field" after pulling cables through cable traces, the soldering requires considerable time. Furthermore, in these special cases extra checking is required after assembly to ascertain that the proper connections have been made. This adds considerably to the time (and cost) of completing an installation of equipment.

Accordingly, it is an object of the present invention to provide a universal cable connector of the "D"-type where all needed solder connections are made during standard manufacturing steps, with actual connection made to wires of the component-connecting cable by mechanical means to eliminate in-the-field soldering.

It is another object to provide an improved cable connector of the "D"-type wherein a circuit board is utilized, as within the hood of the connector, the circuit board having: junctions preconnected to pins of the connector; a terminal strip for the mechanical attachment of the wire ends of the cable; and selectable connections joining the terminal strip and the junctions on the terminal board.

Another object of the invention is to provide a circuit board, as within the housing of a "D"-type connector, the circuit board having junctions permanently wired to pins of the connector and a terminal strip for mechanically attaching the wire ends of a cable, with fuse links joining positions on the terminal strip and the junctions, these fuse links being selectably "blown" to retain selected of the remaining connections between the terminal strip and the junctions to thereby select desired connections between the wires of the cable and pins of the connector.

A further object is to provide means for controlling the selectable "blowing" of fuse links on the circuit board to accomplish the desired connections.

These and other objects of the present invention will become apparent upon a consideration of the accompanying drawings and a complete description thereof as given hereinafter.

DISCLOSURE OF THE INVENTION

In accordance with the present invention there is provided a "universal" cable connector of the "D"-type whereby internal connections are easily selected so as to adapt the connector for specific uses. This is accomplished by, preferably, inserting into the shield hood of the connector a circuit board. This circuit board is provided with an input terminal strip for mechanically joining (solderless connections) the ends of wires making up the cable. The board also has a plurality of junctions hard-wired (e.g., soldered) to the pins of the connector. Joining the points of the terminal strip and the junctions is a fuse link network such that by intentionally destroying (blowing) a selected gooup of fuse links, the remaining fuse links provide the desired connections between the terminal strip and the junctions joined to the pins. This selective blowing of the fuse links thus adapts the connector for a particular cable application. The fuse link network preferably contains resistive devices connected so as to permit a single fuse to be blown without the accompanying blowing of other fuses. Since cable connectors designed for a small number of pins (e.g. nine) may not accomodate a terminal strip, the circuit board and terminal strip are mounted within a supplemental enclosure.

BEST MODE FOR CARRYING OUT THE INVENTION

Figure 1A:
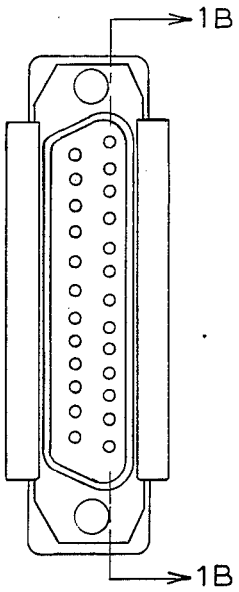
FIG.1A PRIOR ART
FIGS. 1A and 1B are drawings illustrating a typical "D"-type connector of the prior art.
Figure 1B:
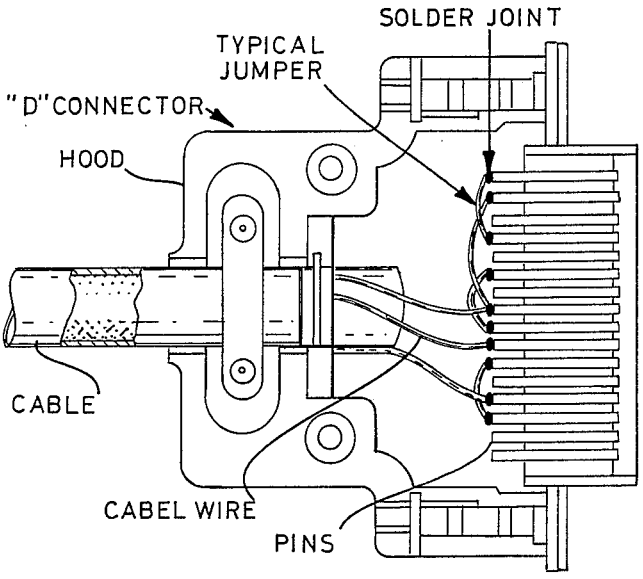
FIG. 1B PRIOR ART
Figure 2:
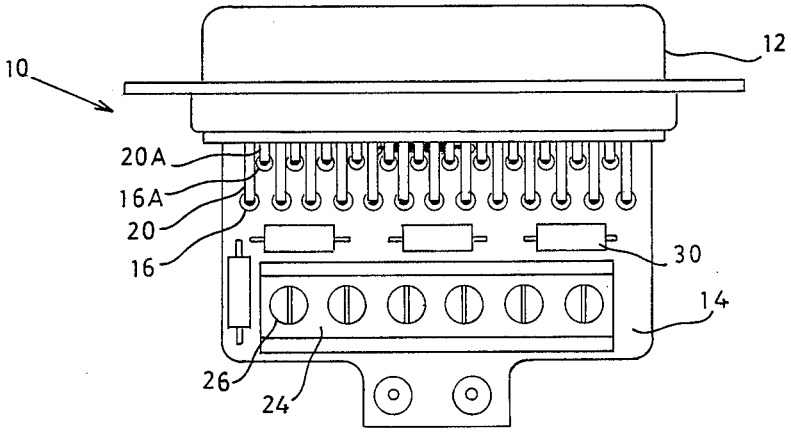
FIG. 2 is a drawing of an improved "D"-type connector of the present invention, with the shielded hood removed, showing the primary components associated therewith.
Figure 4:
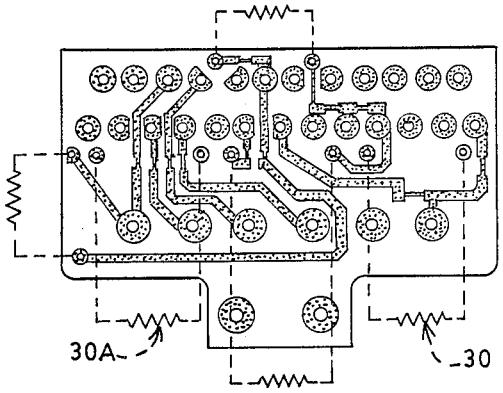
FIG. 4 is a plan view of the circuit board, as in FIG. 3, showing typical connections of the resistive units mounted thereon.
Figure 5:
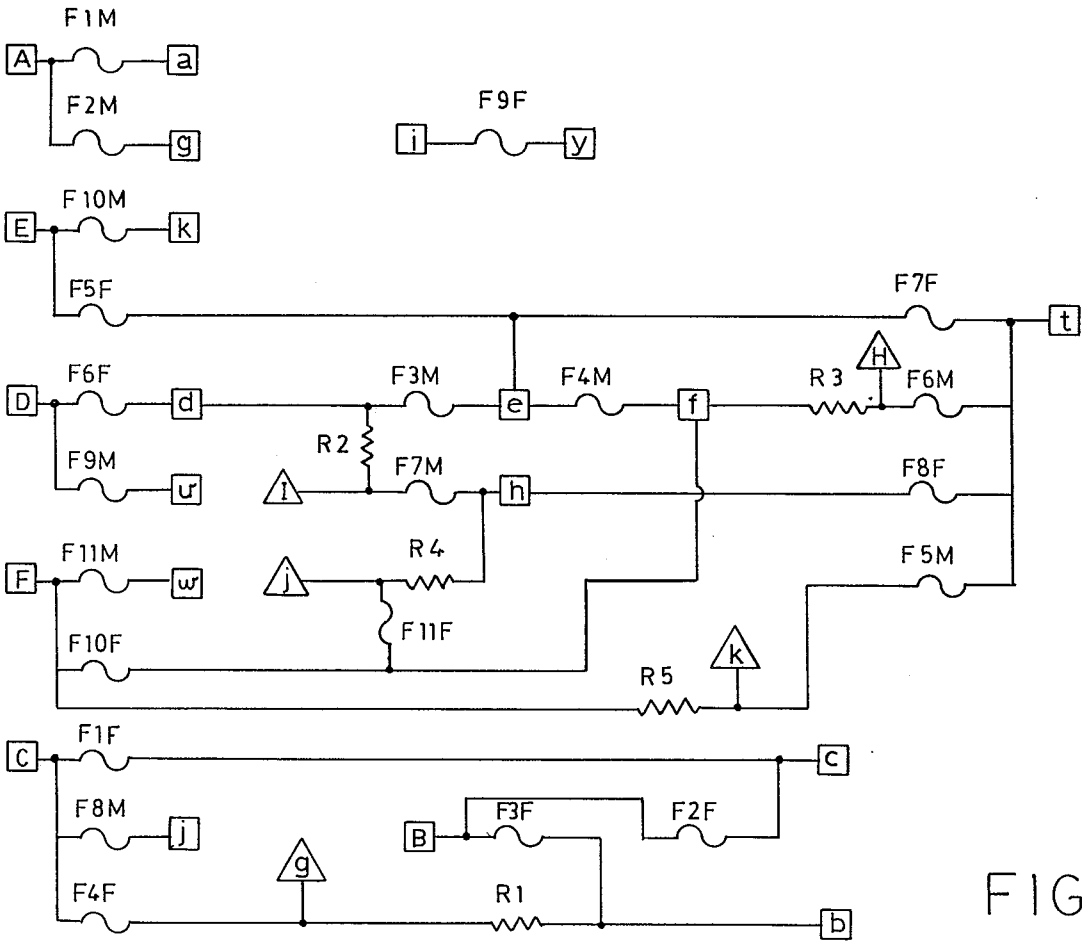
FIG. 5 is a schematic diagram of the connector depicted in FIGS. 2–4 illustrating the fuses of the fuse network and the resistive units utilized to protect some of the fuses while the others are being destroyed to custom configure the connector.

One embodiment of the present invention is shown generally at 10 in FIG. 2. This cable. connector is generally of the same type as that shown in the prior art of FIGS. 1A and 1B in that there is an end portion 12 containing a plurality of pins (e.g., twenty-five). In this FIG. 2, the rearward portion (hood) of the connector shell has been removed in order to permit viewing of a circuit board 14 to be enclosed thereby. This circuit board 14, which is a double-sided board, has a plurality of junction points, as at 16, 16A, etc., that are wired to individual of the aforementioned pins (not shown) with leads 20, 20A, etc., as shown. Typically, these leads are soldered to the junction points on one end, and to the pins on the other end in a conventional manner. Mounted upon the circuit board is a terminal strip 24, of conventional design, having sufficient terminal screws 26 to receive the ends of wires of a cable (not shown) to which the connector is to be mechanically joined. While six terminal screws are shown in this embodiment, there may be more or less for other embodiments of the present invention and depending upon the size of the body of the connector. These cable wire ends are held under the screws in any suitable manner. The circuit board is also provided with a plurality of fuse links 28 (see FIG. 3), and a plurality of resistive units 30. A typical location of the resistive units is illustrated schematically in this figure, and their importance to the present invention will be understood from subsequent description hereinafter. The actual connections of the resistive units are indicated in FIGS. 4 and 5.

Figure 3:
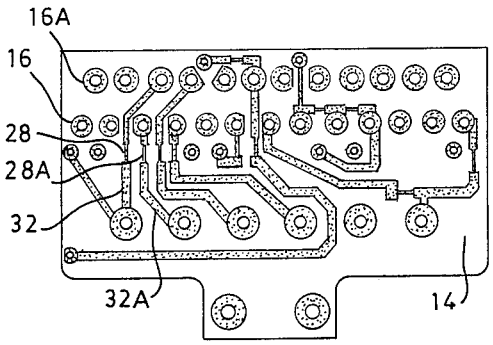
FIG. 3 is a plan view of the circuit board depicted in FIG. 2.

The circuit board 14 is shown in greater detail in FIG. 3. This circuit board is formed in a conventional manner so as to have the conductive junction points 16, 16A, etc. which penetrate the board to the reverse surface. As stated above, these are to be wired to individual pins of the connector. It can be seen that there are twenty-five of these junction points to match the number of the pins in this embodiment. In addition, the circuit board is provided with certain conductive pathways, such as at 32, 32A, etc. Other pathways are on the reverse side (not shown). The number of pathways is dependent upon the number of wires of the cable, and upon the intended use of the cable connector. Each of these pathways contains a fuse link, such as 28A, 28, etc. These fuse links are not utilized in a normal manner to protect a circuit if excessive current flows; rather, they are provided so that certain fuse links can be destroyed (blown) so as to provide the remaining paths in the connector for a particular application. In this way, a "universal" connector can be fabricated with the junction points, pathways and fuse links, after which certain fuse links are blown to leave the remaining paths for the specific application. This permits the soldering of the junction points 16, 16A, etc., to the connector pins under production methods, and the cable wires are joined mechanically by inserting the ends thereof under the terminal screws 26. Thus, cables can be drawn through cable traces, etc., and thereafter the connector is added in a simple manner. This substantially reduces the time of an installation, and greatly simplifies the testing of the system.

As shown above in FIG. 2, a plurality of resistive units 30 are also provided on the circuit board 14. FIG. 4 depicts, schematically, these resistive units with respect to the fuse links. It will be recognized by persons skilled in the art that often circuit boards have a portion of their connections located on two sides (i.e., the circuit board is double sided). Only one side of the circuit board of this embodiment of the present invention is illustrated in FIGS. 3 and 4. However, the complete wiring of this embodiment can be understood by referring to the schematic diagram of FIG. 5. The boxes with capital letters (A through F) represent the terminals 26 on the terminal strip 24, and the boxes with lower case number (a through y) represent the junction points 16 on the circuit board 14. This figure illustrates the fuse network as well as the resistive units 30. The triangles with letters (G through K) represent intermediate junctions as discussed hereinafter with regard to FIG. 6B.

Figure 6A:
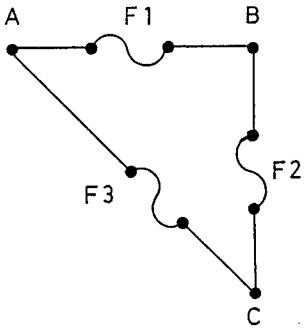
FIGS. 6A and 6B are schematic diagrams of a portion of the circuit of FIG. 5 for the purpose of illustrating the means of control for blowing of individual fuse links of the invention.
Figure 6B:
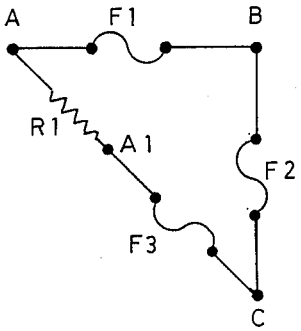

The purpose of the resistive units 30 is to isolate individual fuse links so that current passing through one fuse link, to destroy the same, will not pass through any other fuse link. This can be better understood by referring to FIG. 6A which is a schematic drawing illustrating three junction points designated A, B, and C since they do not represent any specific junction point on either FIGS. 3 or 4. Joining the junction points are three fuse links Fl, F2, and F3. Referring first to FIG. 6A, it can be seen that if current is passed from junction point A to junction point B to blow fuse Fl, there is also a current path through fuses F2 and F3 such that they will also be blown. However, if a resistive unit Rl (equivalent to a resistive unit 30) of relatively high resistance is inserted between junction point A and fuse link F3, using an intermediate junction A1 as illustrated in FIG. 6B, the second current path is effectively removed. Thus, current flowing from junction point A to junction point B will only blow fuse link Fl. Likewise, current flowing from junction point B to junction point C will only blow fuse link F2; and current flowing from junction point C to junction point Al will only blow fuse link F3. It is this protection that is afforded by the total circuit shown in FIG. 5, above. In FIG. 5 the triangles with letters (G through K) are the intermediate junctions. It has been found that resistor units of about 4.5 to about 10 ohms (0.25 watt) provide the desired protection without interfering with the signals to be carried through the connector.

Figure 7:
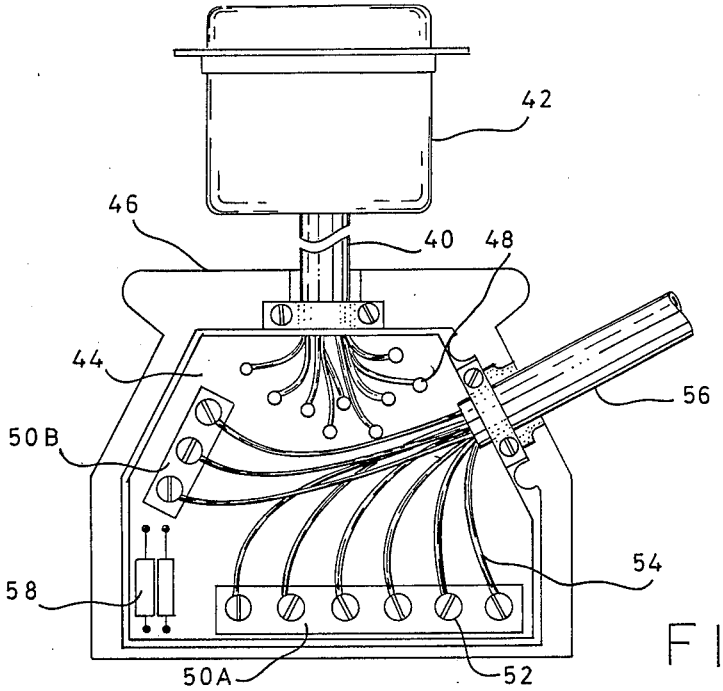
FIG. 7 is a drawing illustrating an embodiment of the present invention for applications where the component connector is of such size that the circuit board and its components cannot be contained therein, with the circuit board then placed in an auxiliary enclosure.

A connector having a small number of pins (e.g. nine pins) may be of a size that will not accomodate a circuit board and its components within the body thereof. The principle of the present invention can be carried out through the use of an auxiliary enclosure as illustrated in FIG. 7. In this embodiment, a "pig-tail" cable 40 is used to couple the actual conventional connector 42 to a circuit board 44 within the cavity of the auxiliary enclosure 46 (shown with a cover removed). This pig-tail cable has the same number of wires therein as the connector has pins (e.g. nine). The ends of these wires are individually soldered to junction points 48 on the circuit board 44 so that these wires function in the same manner as the leads 20 of the embodiment of FIG. 2. This circuit board 44 is provided with a terminal strip 50 (in this embodiment the terminal strip is divided into two portions 50A and 50B for convenience). This terminal strip 50, with terminals as at 52, provides for the mechanical joining of the wires 54 of a cable 56 used to convey the signals between the components as discussed above with regard to the embodiment of FIG. 2. Also shown in this FIG. 7 are resistive units 58 that function with a fuse link network on the circuit board (see FIGS. 8A and 8B).

Figure 8A:
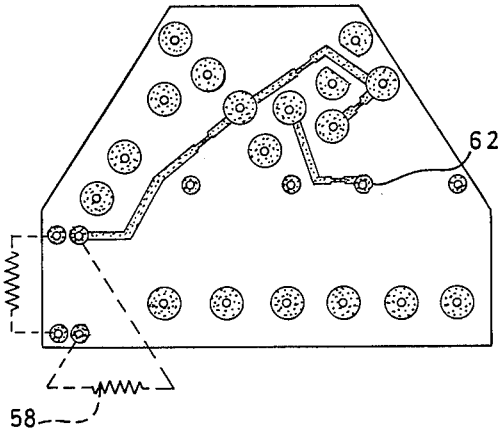
FIG. 8A is a drawing illustrating one surface of the circuit board utilized in the embodiment of FIG. 7.
Figure 8B:
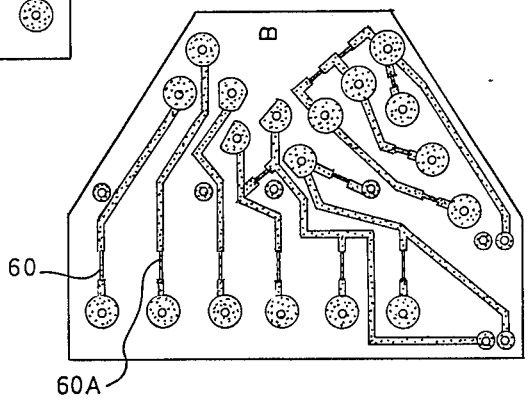
FIG. 8B is a drawing illustrating the reverse surface of the circuit board of FIG. 8A.

The opposite sides of the circuit board 44 of FIG. 7 are depicted in FIGS. 8A and 8B. Shown therein are the individual fuse units as at 60, 60A, etc. that form the needed fuse link network such that specific signal paths can be chosen by destroying selected fuse links to remove signal paths as discussed above. Also shown are the needed intermediate junction points, as at 62, for use with the resistive units 58 to control this selective destruction of the fuse links. The resistive units and their connections are shown with dashed lines; these are the resistive units 58 illustrated in FIG. 7.

The embodiment of FIGS. 7–8 functions in the same manner as the embodiment of FIGS. 2–5 except that only a nine-pin connector is illustrated. Since the terminal strip 50 is illustrated as having nine terminals 52, it can accomodate up to nine wires 54 in the cable 56; however, a cable 56 of a smaller number of wires can also be accomodated if desired. It will be understood that, as in the case of the embodiment of FIG. 2, this embodiment can also utilize a multi-layer circuit board if desired or necessary to accomodate a cable of a greater number of wires.

From the foregoing, it will be understood by persons versed in the art that a "universal" cable connector has been developed that can be easily adapted for a specific application. Furthermore, the connection of the cable wires to this connector of the present invention can be done mechanically without the tedious joining with solder as was required by the prior art. This is accomplished by utilizing a circuit board having junction points that can be routinely joined by solder to the pins of the connector. This circuit board also is provided with a terminal strip to receive ends of the cable wires, and a network of fuse links joining terminals on the terminal strip and the junction points. This universal connector is then converted to a connector for a special application by blowing selected ones of the fuse links so that the remaining fuse links provide the signal paths required for the specific application. Where there is sufficient space within the connector body, the circuit board and its components are mounted within the cavity of the connector. For smaller connector units, the circuit board and its components are mounted within an auxiliary enclosure with a "pig-tail" cable unit joining the connector to the circuit board.

Illustrated herein, in one embodiment, is a connector of the present invention having twenty-five pins and a six-position terminal strip. Another embodiment illustrates the invention for a 9-pin connector. These are given only for illustrative purposes, and the invention is not to be limited by these typical embodiments. Rather, the invention is to be limited only by the appended claims and their equivalents when taken in conjunction with the detailed description of the invention.

We claim:

1. An improved connector of the "D"-type for attachment to the ends of multi-wire cables used to convey signals between electronic components and the like, said components having complementary units to receive said connector, said connector comprising:

a body member of the "D"-type connector, said body provided with an array of signal pins to coact with receptors of said complementary units, said body defining an internal volume;

a circuit board;

a plurality of junction points on said circuit board at least equal in number to said signal pins of said body member;

electrical connections joining each of said junction points to selected ones of said signal pins;

a terminal strip mounted on said circuit board, said terminal strip provided with a sufficient number of terminals to receive ends of said wires of said cable; and a fuse link network on said circuit board joining said terminals of said terminal strip and said junction points, said fuse link network adapted to permit passing current through selected fuse links of said network to destroy said selected fuse links and thereby retain remaining fuse links for carrying signals between said terminals and said junction points.

2. The improved connector of claim 1 further comprising a network of resistive elements mounted on said circuit board, said resistive elements joined to said fuse link network to prevent said current flowing through one of said fuse links, to destroy said one fuse link, from flowing through additional of said fuse links.

3. The improved connector of claim 1 wherein said circuit board is multi-layered, and said fuse link network is distributed on multiple sides of said circuit board.

4. The improved connector of claim 3 wherein said circuit board is double sided, and said fuse link network is distributed on both sides of said circuit board.

5. The improved connector of claim 1 wherein said circuit board is mounted within said internal volume of said body member.

6. The improved connector of claim 1 further comprising an auxiliary body member defining an auxiliary internal cavity, wherein said circuit board is mounted within said auxiliary internal cavity of said auxiliary body member, and wherein said electrical connections joining said junction points and said signal pins comprises a multi-wire pig tail cable extending between said body member and said auxiliary body member.

7. An improved connector of the "D"-type for attachment to the ends of multi-wire cables used to convey signals between electronic components and the like, said components having complementary units to receive said connector, said connector comprising:

a body member of the "D"-type connector, said body provided with an array of signal pins to coact with receptors of said complementary units, said body defining an internal volume;

a circuit board mounted within said internal volume;

a plurality of junction points on said circuit board at least equal in number to said signal pins of said body member;

electrical connections joining each of said junction points to selected ones of said signal pins;

a terminal strip mounted on said circuit board, said terminal strip provided with a sufficient number of terminals to receive ends of said wires of said cable;

a fuse link network on said circuit board joining said terminals of said terminal strip and said junction points, said fuse link network adapted to permit passing current through selected fuse links of said network to destroy said selected fuse links and thereby retain remaining fuse links for carrying signals between said terminals and said junction points; and a network of resistive elements mounted on said circuit board, said resistive elements joined to said fuse link network to substantially prevent said current flowing through one of said fuse links, to destroy said one fuse link, from flowing through additional of said fuse links.

8. The improved connector of claim 7 wherein said circuit board is multilayered, and said fuse link network and said resistive elements are distributed on multiple sides of said circuit board.

9. An improved connector of the "D"-type for attachment to the ends of multi-wire cables used to convey signals between electronic components and the like, said components having complimentary units to receive said connector, said connector comprising:

a body member of the "D"-type connector, said body provided with an array of signal pins to coact with receptors of said complementary units, said body defining an internal volume;

an auxiliary body member defining an auxiliary internal volume;

a circuit board mounted within said auxiliary internal volume;

a plurality of junction points on said circuit board at least equal in number to said signal pins of said body member;

a pigtail cable having wires in number equal to said signal pins of said body, said wires of said pigtail cable individually joining said junction points on said circuit board to said signal pins of said body member;

a terminal strip mounted on said circuit board, said terminal strip provided with a sufficient number of terminals to receive ends of said wires of said cable;

a fuse link network on said circuit board joining said terminals of said terminal strip and said junction points, said fuse link network adapted to permit passing current through selected fuse links of said network to destroy said selected fuse links and thereby retain remaining fuse links for carrying signals between said terminals and said junction points; and a network of resistive elements mounted on said circuit board, said resistive elements joined to said fuse link network to substantially prevent said current flowing through one of said fuse links, to destroy said one fuse link, from flowing through additional of said fuse links.

* * * * *